US010717948B2

(12) United States Patent
Lant et al.

(10) Patent No.: US 10,717,948 B2
(45) Date of Patent: Jul. 21, 2020

(54) METHOD OF LAUNDERING A FABRIC

(71) Applicant: The Procter & Gamble Company, Cincinnati, OH (US)

(72) Inventors: Neil Joseph Lant, Newcastle upon Tyne (GB); Linsey Sarah Bennie, Newcastle upon Tyne (GB); Steven George Patterson, Tyne & Wear (GB); Lindsay Suzanne Bewick, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 42 days.

(21) Appl. No.: 14/183,681

(22) Filed: Feb. 19, 2014

(65) Prior Publication Data

US 2014/0230157 A1 Aug. 21, 2014

(30) Foreign Application Priority Data

Feb. 19, 2013 (EP) ..... 13155784

(51) Int. Cl.

| | |
|---|---|
| ***C11D 3/386*** | (2006.01) |
| ***C11D 3/42*** | (2006.01) |
| ***C11D 3/40*** | (2006.01) |
| ***C11D 11/00*** | (2006.01) |

(52) U.S. Cl.

CPC ..... *C11D 3/38636* (2013.01); *C11D 3/40* (2013.01); *C11D 3/42* (2013.01); *C11D 11/0017* (2013.01)

(58) Field of Classification Search

CPC ..... C11D 3/38636; C11D 3/40; C11D 3/42; C11D 11/0017

See application file for complete search history.

(56) References Cited

U.S. PATENT DOCUMENTS

| | | | |
|---|---|---|---|
| 5,427,936 A | 6/1995 | Moeller et al. | |
| 6,265,191 B1 | 7/2001 | Mizusawa et al. | |
| 6,495,357 B1 | 12/2002 | Fuglsang et al. | |
| 7,786,067 B2 | 8/2010 | Souter et al. | |
| 7,910,533 B2 | 3/2011 | Somerville Roberts et al. | |
| 8,722,611 B2 | 5/2014 | Lant | |
| 2009/0217463 A1 | 9/2009 | Souter et al. | |
| 2014/0206593 A1* | 7/2014 | Simonsen | C11D 3/38672 510/374 |
| 2014/0230155 A1 | 8/2014 | Lant et al. | |
| 2014/0230156 A1 | 8/2014 | Lant et al. | |

FOREIGN PATENT DOCUMENTS

| | | | |
|---|---|---|---|
| EP | 0 476 915 A2 | | 3/1992 |
| EP | 2251404 | * | 1/2007 |
| EP | 2 251 404 A1 | | 11/2010 |
| WO | WO 91/16422 A1 | | 10/1991 |
| WO | WO 95/11292 A1 | | 4/1995 |
| WO | WO 96/12012 1 | | 4/1996 |
| WO | WO 00/42151 A1 | | 7/2000 |
| WO | WO2009/068513 | * | 6/2009 |
| WO | WO 2009/068513 A2 | | 6/2009 |
| WO | WO2010/151906 | * | 12/2010 |
| WO | WO 2010/151906 A2 | | 12/2010 |
| WO | WO 2012/059363 A1 | | 5/2012 |
| WO | WO 2012/136427 A1 | | 10/2012 |

OTHER PUBLICATIONS

European Search Report for Application No. 13155776.1-1358, dated May 28, 2013, 6 pages.
European Search Report for Application No. 13155780.3-1358, dated May 28, 2013, 6 pages.
European Search Report for Application No. 13155784.5-1358, dated May 28, 2013, 6 pages.
U.S. Appl. No. 14/183,626, filed Feb. 19, 2014, Lant et al.
U.S. Appl. No. 14/183,649, filed Feb. 19, 2014, Lant et al.
KEGG database definition of EC 3.1.1.1, 2015, p. 1.
KEGG database definition of EC 3.1.1.74, 2015, p. 1.
EBI EC-PDB database definition of EC 3.1.1.3, 2015, p. 1.

* cited by examiner

*Primary Examiner* — Amina S Khan
(74) *Attorney, Agent, or Firm* — John T. Dipre

(57) ABSTRACT

A method of laundering a fabric comprising the steps of; (i) contacting the fabric with a cutinase, (ii) contacting the fabric from step (i) with a soil; (iii) contacting the fabric from step (ii) with a laundry detergent composition, wherein the laundry detergent composition comprises a hueing agent.

7 Claims, No Drawings

METHOD OF LAUNDERING A FABRIC

FIELD OF THE INVENTION

The present invention relates to methods of laundering fabrics.

BACKGROUND OF THE INVENTION

As fabrics age, their color tends to fade or yellow due to exposure to light, air, soil, and natural degradation of the fibers that comprise the fabrics. To counteract this unwanted effect, laundry detergent manufacturers incorporate hueing agents into their products. Deposition of hueing dye onto white fabric, provides the consumer with a perception of increased whiteness, and counteracts the fading and yellowing of fabrics.

Thus, the purpose of hueing agents is typically to provide whiteness perception to fabrics and counteract the fading and yellowing of the fabrics.

It is believed that the ability of hueing agents to counteract fading and yellowing of textile fabrics is limited by the presence of soil in the wash liquor which has been removed from the fabric but which redeposits during the wash step. This redeposited soil affects the ability of the deposited hueing agent to provide hueing benefit to the dried fabrics.

Thus, there is a need in the art for an improved method of counteracting fading and yellowing of fabrics.

The Inventors have surprisingly found that the method the present invention solves this problem.

SUMMARY OF THE INVENTION

The present invention is to a method of laundering a fabric comprising the steps of; (i) contacting the fabric is with a cutinase, (ii) contacting the fabric from step (i) with a soil; (iii) contacting the fabric from step (ii) with a laundry detergent composition, wherein the laundry detergent composition comprises a hueing agent.

The present invention is also to a laundry detergent composition comprising; a cutinase; and a shading dye.

The present invention is also to the use of a cutinase to improve the deposition of a shading dye on a fabric

DETAILED DESCRIPTION OF THE INVENTION

The Method

The present invention is to a method of laundering a fabric comprising the steps of;

(i) contacting the fabric with a cutinase, (ii) contacting the fabric from step (i) with a soil;

(iii) contacting the fabric from step (ii) with a laundry detergent composition, wherein the laundry detergent composition comprises a hueing agent.

A fabric may be contacted with a cutinase in step (i) in a wash operation. The fabric may then be dried and worn by a consumer or used in another way for its intended use. It is during the use of the fabric that it is contacted with a soil. Following use of the fabric by the consumer the fabric may then be contacted with a laundry detergent composition in step (iii). Without wishing to be bound by theory, it is believed that the cutinase contacted to the fabric in step (i) acts to reduce soil redeposition during the wash. During the wash cycle, soils present in the fabric are removed from the fabric and are present in the wash liquor. There is a tendency for the soils to then redeposit onto the fabrics. This redeposition affects the hueing ability of the hueing agent deposited on the fabrics.

Step (i)

The method of the present invention comprises a step (i) of contacting a fabric with a cutinase. Preferably, the cutinase is contacted in a previous wash operation and the fabric subsequently dried. The cutinase may have been previously deposited by washing the fabric in a wash liquor comprising the cutinase. For example the wash liquor may be formed in a wash cycle of a machine wash operation. Alternatively, the cutinase may have been added to the fabric in the form of a pre-treater. For example it may have been deposited as a pre-treat stain remover composition. In this aspect, the pre-treat composition is added to a portion or all of the fabric at some point before it is subjected to a wash operation. Alternatively, the pre-treat composition is added to a specific stain on the fabric at some point before the fabric is subjected to a wash operation. Alternatively the cutinase may have been deposited on the fabric during fabric manufacture.

The cutinase is preferably selected from class E.C. 3.1.1.74. By 'E.C. class' we herein mean the Enzyme Commission class. The Enzyme Commission class is an international recognized enzyme classification scheme based on chemical reactions that the enzymes catalyse. Suitable cutinases can be selected from wild-types or variants of cutinases endogenous to strains of *Aspergillus*, in particular *Aspergillus oryzae*, a strain of *Alternaria*, in particular *Alternaria brassiciola*, a strain of *Fusarium*, in particular *Fusarium solani, Fusarium solani pisi, Fusarium oxysporum, Fusarium oxysporum cepa, Fusarium roseum culmorum*, or *Fusarium roseum sambucium*, a strain of *Helminthosporum*, in particular *Helminthosporum sativum*, a strain of *Humicola*, in particular *Humicola insolens*, a strain of *Pseudomonas*, in particular *Pseudomonas mendocina*, or *Pseudomonas putida*, a strain of *Rhizoctonia*, in particular *Rhizoctonia solani*, a strain of *Streptomyces*, in particular *Streptomyces scabies*, a strain of *Coprinopsis*, in particular *Coprinopsis cinerea*, a strain of *Thermobifida*, in particular *Thermobifida fusca*, a strain of *Magnaporthe*, in particular *Magnaporthe grisea*, or a strain of *Ulocladium*, in particular *Ulocladium consortiale*.

In a preferred embodiment, the cutinase is selected from variants of the *Pseudomonas mendocina* cutinase described in WO 2003/076580 (Genencor), such as the variant with three substitutions at I178M, F180V, and S205G.

In another preferred embodiment, the cutinase is a wild-type or variant of the six cutinases endogenous to *Coprinopsis cinerea* described in H. Kontkanen et al, App. Environ. Microbiology, 2009, p 2148-2157

In another preferred embodiment, the cutinase is a wild-type or variant of the two cutinases endogenous to *Trichoderma reesei* described in WO2009007510 (VTT).

In a most preferred embodiment the cutinase is derived from a strain of *Humicola insolens*, in particular the strain *Humicola insolens* DSM 1800. *Humicola insolens* cutinase is described in WO 96/13580 which is hereby incorporated by reference. The cutinase may be a variant, such as one of the variants disclosed in WO 00/34450 and WO 01/92502. Preferred cutinase variants include variants listed in Example 2 of WO 01/92502.

The cutinase may be a variant corresponding to Claim 5, part (u) of EP1290150B1.

The fabric may have been contacted with a cutinase at a concentration of between 30 and 55,000 ng enzyme/g fabric. Alternatively, the fabric may have been contacted with the cutinase at a concentration of between 100 and 35,000 ng enzyme/g fabric, or even between 500 and 30,000 ng enzyme/g fabric. Without wishing to be bound by theory, it is believed that these concentrations are optimal for soil removal from the fabrics The fabric may be any suitable fabric. The fabric may comprise natural or synthetic materials or a combination thereof. The fabric may comprise cotton, polycotton, polyester, or a combination thereof. The fabric may comprise cotton.

Without wishing to be bound by theory, it is believed that the cutinase hydrolysises the fabrics out of the wash. The makes the fabric surface more hydrophilic thus repelling the soil (which is hydrophobic) and so reduce soil redeposition. It is also believed that the cutinase present on the fabrics from step (i) comes away from the fabric in the wash liquor to act on the soil present in the wash liquor, hence less soil is redeposited onto the fabrics.

The cutinase in step (i) can be used in combination with any other known laundry detergent ingredients detailed below.

Step (ii)

The method of the present invention comprises a step (ii) of contacting the fabric from step (i) with a soil. By 'soil' we herein mean any organic or inorganic material that is deposited onto the fabric that the consumer perceives as dirtying the fabric. The soil could be a stain, for example a greasy or oily food stain, or body soils such as sweat or blood. Other common stains include red food stains, clay-based stains and grass stains. Alternatively, the soil could be atmospheric soil such as chemical pollutants, dust or soot. The soil may be water-soluble or water-insoluble. These are non-limiting examples. Those skilled in the art would know what is meant by 'soil' in the context of the present invention.

Step (iii)

The method of the present invention comprises a step (iii) of contacting the fabric from step (ii) with a laundry detergent composition.

The composition may be in any suitable form including granular, liquid or unitized dose. When in unitized dose form, it is preferred that the composition is enclosed with a water-soluble film, for example a polyvinyl alcohol-based film.

The fabric may be contacted with the composition in step (iii) in the form of a wash liquor, or even a wash liquor in a machine wash cycle. Alternatively, the fabric may be contacted with the composition in the form of a wash pre-treat composition. In this aspect, the pre-treat composition is added to a portion or all of the fabric at some point before it is contacted with a wash liquor. Alternatively, the pre-treat composition may be added to a specific stain on the fabric at some point before the fabric is contacted with a wash liquor.

The laundry detergent composition comprises a hueing agent. Typically, the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof. Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Acid, Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in US 2008/034511 A1 or U.S. Pat. No. 8,268,016 B2, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Preferred dyes include dye polymers, wherein a dye group is bound to a polymeric group, optionally via a linking group. Suitable polymeric groups include (1) alkoxylated polyethyleneimine (for example as disclosed in WO2012119859), (2) polyvinyl alcohol (for example as disclosed in WO2012130492), or (3) diamine derivative of an alkylene oxide capped polyethylene glycol (for example as disclosed in WO2012126665, especially FIG. 24), or polyalkoxylated alcohol, for example as described in WO2011/011799, WO2012/054058, WO2012/166699 or WO2012/166768. One preferred class of dye polymers is obtainable by reacting a blue or violet dye containing an NH2 group with a polymer to form a covalent bond via the reacted NH2 group of the blue or violet dye and the dye polymer has an average of from 0 to 30, preferably 2 to 20, most preferably 2 to 15 repeating same units. In a preferred embodiment the monomeric units are selected from alkylene oxides, preferably ethylene oxides. Typically dye polymers will be in the form of a mixture of dye polymers in which there is a mixture of molecules having a distribution of number of monomer groups in the polymer chains, such as the mixture directly produced by the appropriate organic synthesis route, for example in the case of alkylene oxide polymers, the result of an alkoxylation reaction. Such dye polymers are typically blue or violet in colour, to give to the cloth a hue angle of 230 to 345, more preferably 250 to 330, most preferably 270 to 300. In the synthesis of dye polymers unbound blue or violet organic dyes may be present in a mixture with the final dye-polymer product. The chromophore of the blue or violet dye is preferably selected from the group consisting of: azo; anthraquinone; phthalocyanine; triphendioxazine; and, triphenylmethane. In one aspect the dye polymer is obtainable by reacting a dye containing an NH[2] group with a polymer or suitable monomer that forms a polymer in situ. Preferably the NH[2] is covalently bound to an aromatic ring of the dye. Unbound dye is formed when the dye does not react with polymer. Preferred dyes containing —NH[2] groups for such reactions are selected from:

acid violet 1; acid violet 3; acid violet 6; acid violet 11; acid violet 13; acid violet 14; acid violet 19; acid violet 20; acid violet 36; acid violet 36:1; acid violet 41; acid violet 42; acid violet 43; acid violet 50; acid violet 51; acid violet 63; acid violet 48; acid blue 25; acid blue 40; acid blue 40:1; acid blue 41; acid blue 45; acid blue 47; acid blue 49; acid blue 51; acid blue 53; acid blue 56; acid blue 61; acid blue 61:1; acid blue 62; acid blue 69; acid blue 78; acid blue 81:1; acid blue 92; acid blue 96; acid blue 108; acid blue 111; acid blue 215; acid blue 230; acid blue 277; acid blue 344; acid blue 117; acid blue 124; acid blue 129; acid blue 129:1; acid blue 138; acid blue 145; direct violet 99; direct violet 5; direct violet 72; direct violet 16; direct violet 78; direct violet 77; direct violet 83; food black 2; direct blue 33; direct blue 41; direct blue 22; direct blue 71; direct blue 72; direct blue 74; direct blue 75; direct blue 82; direct blue 96; direct blue 110; direct blue 111; direct blue 120; direct blue 120:1; direct blue 121; direct blue 122; direct blue 123; direct blue 124; direct blue 126; direct blue 127; direct blue 128; direct blue 129; direct blue 130; direct blue 132; direct blue 133; direct blue 135; direct blue 138; direct blue 140; direct blue 145; direct blue 148; direct blue 149; direct blue 159; direct blue 162; direct blue 163; food black 2; food black 1 wherein the acid amide group is replaced by NH[2]; Basic Violet 2; Basic Violet 5; Basic Violet 12; Basic Violet 14; Basic Violet 8; Basic Blue 12; Basic Blue 16; Basic Blue 17; Basic Blue 47; Basic Blue 99; disperse blue 1; disperse blue 5; disperse blue 6; disperse blue 9; disperse blue 11; disperse blue 19; disperse blue 20; disperse blue 28; disperse blue 40; disperse blue 56; disperse blue 60; disperse blue 81; disperse blue 83; disperse blue 87; disperse blue 104; disperse blue 118; disperse violet 1; disperse violet 4, disperse violet 8, disperse violet 17, disperse violet 26; disperse violet 28; solvent violet 26; solvent blue 12; solvent blue 13; solvent blue 18; solvent blue 68. Further preferred dyes are selected from mono-azo dyes which contain a phenyl group directly attached to the azo group, wherein the phenyl group has an NH[2] groups covalent bound to it. For example a mono-azo thiophene dye. The polymer chain may be selected from polyalkylene oxides. The polymer chain and/or the dye chromophore group may optionally carry anionic or cationic groups. Examples of polyoxyalkylene oxide chains include ethylene oxide, propylene oxide, glycidol oxide, butylene oxide and mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, US 2012/225803 A1, US 2012/090102 A1, U.S. Pat. No. 7,686,892 B2, and WO2010/142503.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferred hueing dyes include the whitening agents found in WO 08/87497 A1, WO2011/011799 and US 2012/129752 A1. Preferred hueing agents for use in the present invention may be the preferred dyes disclosed in these references, including those selected from Examples 1-42 in Table 5 of WO2011/011799. Other preferred dyes are disclosed in U.S. Pat. No. 8,138,222B2, especially claim 1 of U.S. Pat. No. 8,138,222B2. Other preferred dyes are disclosed in U.S. Pat. No. 7,909,890 B2.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The hueing agent may having the following structure:

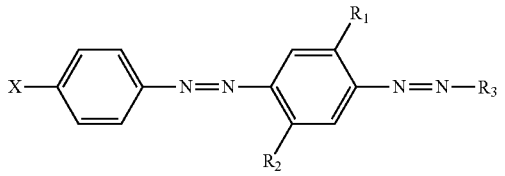

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and optionally an alkyl and/or aryl moiety, and wherein the substituent group comprises at least one alkyleneoxy chain that comprises at least four alkyleneoxy moieties.

The hueing agent may comprise a) a Zn-, Ca-, Mg-, Na-, K-, Al, Si-, Ti-, Ge-, Ga-, Zr-, In- or Sn-phthalocyanine compound of formula (I)

(PC)-L-(D) (1)

to which at least one mono-azo dyestuff is attached through a covalent bonding via a linking group L wherein PC is a metal-containing phthalocyanine ring system;

D is the radical of a mono-azo dyestuff; and

L is a group

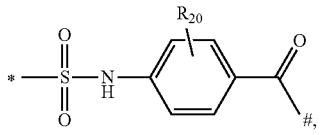

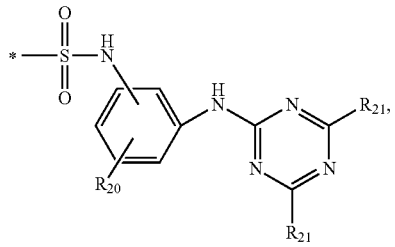

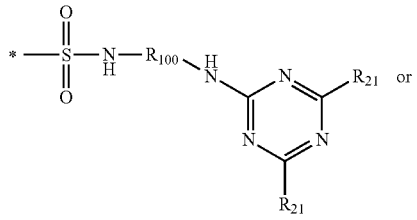

-continued

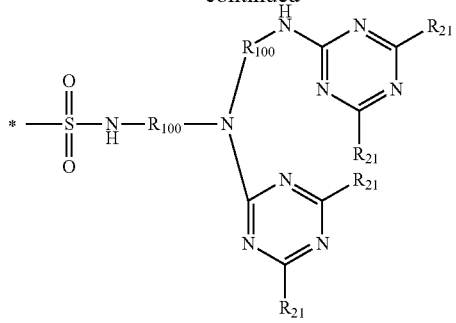

wherein $R_{20}$ is hydrogen, $C_1$-$C_8$alkyl, $C_1$-$C_8$alkoxy or halogen;

$R_{21}$ is independently D, hydrogen, OH, Cl or F, with the proviso that at least one is D;

$R_{100}$ is $C_1$-$C_8$alkylene

* is the point of attachment of PC;

# is the point of attachment of the dye.

The aforementioned fabric hueing agents can be used in combination (any mixture of fabric hueing agents can be used).

The laundry detergent composition may also comprise a lipid esterase. The laundry detergent composition may comprise a lipid esterase selected from class E.C. 3.1.1.74. Without wishing to be bound by theory, the lipid esterase present in the laundry detergent composition is deposited onto the clean fabrics during the wash. Thus, the presence of a lipid esterase in step (iii) ensures sufficient deposition and accumulation of lipid esterase on the fabric ahead of addition of any soil during step (ii).

Without wishing to be bound by theory, it is believed that a lipid esterase as detailed in the present claims which has been deposited on a fabric works to reduce the adherence of a stain on the fabric out of the wash. The pre-deposited lipid esterase may reduce the adherence of a stain already on the fabric prior to deposition of the lipid esterase, or one in which a stain is applied to the fabric following deposition of the lipid esterase onto the fabric. Since adherence of the stain to the fabric is reduced, upon washing the fabric with a laundry detergent composition, the ability to remove the stain is improved as compared to the prior art. This is particularly beneficial when the soiled fabrics are washed at lower temperatures and at lower wash cycle times. There is tendency for consumers to wash fabrics at lower temperatures and for shorter wash cycles. This is more environmentally friendly and reduces energy consumption. However, colder temperatures and short wash cycles tend to remove less soil than higher temperatures and longer wash cycles. Thus there is a need in the art for methods of effectively removing soil from fabrics at this lower temperatures and shorter wash cycles. It was surprisingly found that the method of the present invention providing excellent soil removal from fabrics at lower temperatures. It was also surprisingly found that the method of the present invention provided excellent soil removal from fabrics in shorter wash cycles.

The fabric may be contacted with the composition in step (iii) at a temperature of 60° C. or less, or even 40° C. or less. The fabric may be contacted with the composition at a temperature of between 5° C. and 50° C., preferably between 10° C. and 30° C. The fabric may be contacted at these temperatures in the wash cycle of a domestic washing machine.

The fabric may be contacted with a laundry detergent composition in step (iii) in a wash cycle of an automatic washing machine and the length of the wash cycle may be at least 30 seconds, or even at least 3 mins, or even at least 6 mins, but no more than 30 mins, or even no more than 45 mins, or even no more than 1 hour.

Other Ingredients

The laundry detergent composition of step (iii) may comprise further laundry detergent ingredients. The laundry detergent composition of step (iii) may comprise a hueing agent, a polymer or a combination thereof. Suitable detergent ingredients include: detersive surfactants including anionic detersive surfactants, non-ionic detersive surfactants, cationic detersive surfactants, zwitterionic detersive surfactants, amphoteric detersive surfactants, and any combination thereof; polymers including carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof; builders including zeolites, phosphates, citrate, and any combination thereof buffers and alkalinity sources including carbonate salts and/or silicate salts; fillers including sulphate salts and bio-filler materials; bleach including bleach activators, sources of available oxygen, pre-formed peracids, bleach catalysts, reducing bleach, and any combination thereof; chelants; photobleach; hueing agents; brighteners; enzymes including proteases, amylases, cellulases, lipases, xylogucanases, pectate lyases, mannanases, bleaching enzymes, cutinases, and any combination thereof; fabric softeners including clay, silicones, quaternary ammonium fabric-softening agents, and any combination thereof; flocculants such as polyethylene oxide; perfume including starch encapsulated perfume accords, perfume microcapsules, perfume loaded zeolites, schif base reaction products of ketone perfume raw materials and polyamines, blooming perfumes, and any combination thereof; aesthetics including soap rings, lamellar aesthetic particles, geltin beads, carbonate and/or sulphate salt speckles, coloured clay, and any combination thereof: and any combination thereof.

Cationic Detersive Surfactant:

Suitable cationic detersive surfactants include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, such as chloride; sulphate; and sulphonate. Suitable cationic detersive surfactants are mono-$C_{6-18}$ alkyl mono-hydroxyethyl di-methyl quaternary ammonium chlorides. Suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Polymer:

Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Carboxylate Polymer:

Suitable carboxylate polymers include maleate/acrylate random copolymer or polyacrylate homopolymer. The carboxylate polymer may be a polyacrylate homopolymer having a molecular weight of from 4,000 Da to 9,000 Da, or from 6,000 Da to 9,000 Da. Other suitable carboxylate polymers are co-polymers of maleic acid and acrylic acid, and may have a molecular weight in the range of from 4,000 Da to 90,000 Da.

Other suitable carboxylate polymers are co-polymers comprising: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

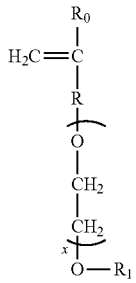

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

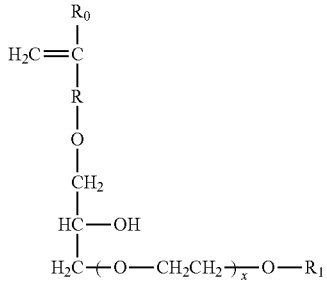

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

Polyethylene Glycol Polymer:

Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4. A suitable polyethylene glycol polymer is Sokalan HP22.

Polyester Soil Release Polymers:

Suitable polyester soil release polymers have a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is H, Na, Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or any mixture thereof.

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group. Suitable polyester soil release polymers are terephthalate polymers having the structure of formula (I) or (II) above.

Suitable polyester soil release polymers include the Repel-o-tex series of polymers such as Repel-o-tex SF2 (Rhodia) and/or the Texcare series of polymers such as Texcare SRA300 (Clariant).

Amine Polymer:

Suitable amine polymers include polyethylene imine polymers, such as alkoxylated polyalkyleneimines, optionally comprising a polyethylene and/or polypropylene oxide block.

Cellulosic Polymer:

The composition can comprise cellulosic polymers, such as polymers selected from alkyl cellulose, alkyl alkoxyalkyl cellulose, carboxyalkyl cellulose, alkyl carboxyalkyl, and any combination thereof. Suitable cellulosic polymers are selected from carboxymethyl cellulose, methyl cellulose, methyl hydroxyethyl cellulose, methyl carboxymethyl cellulose, and mixtures thereof. The carboxymethyl cellulose can have a degree of carboxymethyl substitution from 0.5 to 0.9 and a molecular weight from 100,000 Da to 300,000 Da. Another suitable cellulosic polymer is hydrophobically modified carboxymethyl cellulose, such as Finnfix SH-1 (CP Kelco).

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Dye Transfer Inhibitor Polymer:

The laundry detergent compositions may comprise DTI polymers. Suitable DTIs include polyamine N-oxide polymers, copolymers of N-vinylpyrrolidone and N-vinylimidazole, polyvinylpyrrolidone polymers, polyvinyloxazolidones and polyvinylimidazoles or mixtures thereof. The DTI polymers discussed above are well known in the art and commercially available, for example PVP-K15 and K30 (Ashland), Sokalan HP165, HP50, HP53, HP59, HP56K, HP56, HP66 (BASF), Chromabond S-400, 5403E and S-100 (Ashland), and Polyquart FDI (Cognis).

Hexamethylenediamine Derivative Polymers:

Suitable polymers include hexamethylenediamine derivative polymers, typically having the formula:

$$R_2(CH_3)N^+(CH_2)6N^+(CH_3)R_2.2X^-$$

wherein $X^-$ is a suitable counter-ion, for example chloride, and R is a poly(ethylene glycol) chain having an average degree of ethoxylation of from 20 to 30. Optionally, the poly(ethylene glycol) chains may be independently capped with sulphate and/or sulphonate groups, typically with the charge being balanced by reducing the number of $X^-$ counter-ions, or (in cases where the average degree of sulphation per molecule is greater than two), introduction of $Y^+$ counter-ions, for example sodium cations.

Builder:

Suitable builders include zeolites, phosphates, citrates, and any combination thereof.

Zeolite Builder:

The composition may be substantially free of zeolite builder. Substantially free of zeolite builder typically means comprises from 0 wt % to 10 wt %, zeolite builder, or to 8 wt %, or to 6 wt %, or to 4 wt %, or to 3 wt %, or to 2 wt %, or even to 1 wt % zeolite builder. Substantially free of zeolite builder preferably means "no deliberately added" zeolite builder. Typical zeolite builders include zeolite A, zeolite P, zeolite MAP, zeolite X and zeolite Y.

Phosphate Builder:

The composition may be substantially free of phosphate builder. Substantially free of phosphate builder typically means comprises from 0 wt % to 10 wt % phosphate builder, or to 8 wt %, or to 6 wt %, or to 4 wt %, or to 3 wt %, or to 2 wt %, or even to 1 wt % phosphate builder. Substantially free of zeolite builder preferably means "no deliberately added" phosphate builder. A typical phosphate builder is sodium tri-polyphosphate (STPP).

Citrate:

A suitable citrate is sodium citrate. However, citric acid may also be incorporated into the composition, which can form citrate in the wash liquor.

Buffer and Alkalinity Source:

Suitable buffers and alkalinity sources include carbonate salts and/or silicate salts and/or double salts such as burkeitte.

Carbonate Salt:

A suitable carbonate salt is sodium carbonate and/or sodium bicarbonate. The composition may comprise bicarbonate salt. It may be suitable for the composition to comprise low levels of carbonate salt, for example, it may be suitable for the composition to comprise from 0 wt % to 10 wt % carbonate salt, or to 8 wt %, or to 6 wt %, or to 4 wt %, or to 3 wt %, or to 2 wt %, or even to 1 wt % carbonate salt. The composition may even be substantially free of carbonate salt; substantially free means "no deliberately added".

The carbonate salt may have a weight average mean particle size of from 100 to 500 micrometers. Alternatively, the carbonate salt may have a weight average mean particle size of from 10 to 25 micrometers.

Silicate Salt:

The composition may comprise from 0 wt % to 20 wt % silicate salt, or to 15 wt %, or to 10 wt %, or to 5 wt %, or to 4 wt %, or even to 2 wt %, and may comprise from above 0 wt %, or from 0.5 wt %, or even from 1 wt % silicate salt. The silicate can be crystalline or amorphous. Suitable crystalline silicates include crystalline layered silicate, such as SKS-6. Other suitable silicates include 1.6R silicate and/or 2.0R silicate. A suitable silicate salt is sodium silicate. Another suitable silicate salt is sodium metasilicate.

Filler:

The composition may comprise from 0 wt % to 70% filler. Suitable fillers include sulphate salts and/or bio-filler materials.

Sulphate Salt:

A suitable sulphate salt is sodium sulphate. The sulphate salt may have a weight average mean particle size of from 100 to 500 micrometers, alternatively, the sulphate salt may have a weight average mean particle size of from 10 to 45 micrometers.

Bio-Filler Material:

A suitable bio-filler material is alkali and/or bleach treated agricultural waste.

Bleach:

The composition may comprise bleach. Alternatively, the composition may be substantially free of bleach; substantially free means "no deliberately added". Suitable bleach includes bleach activators, sources of available oxygen, pre-formed peracids, bleach catalysts, reducing bleach, and any combination thereof. If present, the bleach, or any component thereof, for example the pre-formed peracid, may be coated, such as encapsulated, or clathrated, such as with urea or cyclodextrin.

Bleach Activator:

Suitable bleach activators include: tetraacetylethylenediamine (TAED); oxybenzene sulphonates such as nonanoyl oxybenzene sulphonate (NOBS), caprylamidononanoyl oxybenzene sulphonate (NACA-OBS), 3,5,5-trimethyl hexanoyloxybenzene sulphonate (Iso-NOBS), dodecyl oxybenzene sulphonate (LOBS), and any mixture thereof; caprolactams; pentaacetate glucose (PAG); nitrile quaternary ammonium; imide bleach activators, such as N-nonanoyl-N-methyl acetamide; and any mixture thereof.

Source of Available Oxygen:

A suitable source of available oxygen (AvOx) is a source of hydrogen peroxide, such as percarbonate salts and/or perborate salts, such as sodium percarbonate. The source of peroxygen may be at least partially coated, or even completely coated, by a coating ingredient such as a carbonate salt, a sulphate salt, a silicate salt, borosilicate, or any mixture thereof, including mixed salts thereof. Suitable percarbonate salts can be prepared by a fluid bed process or by a crystallization process. Suitable perborate salts include sodium perborate mono-hydrate (PB1), sodium perborate tetra-hydrate (PB4), and anhydrous sodium perborate which is also known as fizzing sodium perborate. Other suitable sources of AvOx include persulphate, such as oxone. Another suitable source of AvOx is hydrogen peroxide.

Pre-Formed Peracid:

A suitable pre-formed peracid is N,N-pthaloylamino peroxycaproic acid (PAP).

Bleach Catalyst:

Suitable bleach catalysts include oxaziridinium-based bleach catalysts, transition metal bleach catalysts and bleaching enzymes.

Oxaziridinium-Based Bleach Catalyst:

A suitable oxaziridinium-based bleach catalyst has the formula:

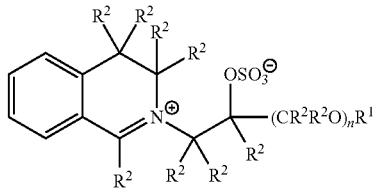

wherein: $R^1$ is selected from the group consisting of: H, a branched alkyl group containing from 3 to 24 carbons, and a linear alkyl group containing from 1 to 24 carbons; $R^1$ can be a branched alkyl group comprising from 6 to 18 carbons, or a linear alkyl group comprising from 5 to 18 carbons, $R^1$ can be selected from the group consisting of: 2-propylheptyl, 2-butyloctyl, 2-pentylnonyl, 2-hexyldecyl, n-hexyl, n-octyl, n-decyl, n-dodecyl, n-tetradecyl, n-hexadecyl, n-octadecyl, iso-nonyl, iso-decyl, iso-tridecyl and iso-pentadecyl; $R^2$ is independently selected from the group consisting of: H, a branched alkyl group comprising from 3 to 12 carbons, and a linear alkyl group comprising from 1 to 12 carbons; optionally $R^2$ is independently selected from H and methyl groups; and n is an integer from 0 to 1.

Transition Metal Bleach Catalyst:

The composition may include transition metal bleach catalyst, typically comprising copper, iron, titanium, ruthenium, tungsten, molybdenum, and/or manganese cations. Suitable transition metal bleach catalysts are manganese-based transition metal bleach catalysts.

Reducing Bleach:

The composition may comprise a reducing bleach. However, the composition may be substantially free of reducing bleach; substantially free means "no deliberately added". Suitable reducing bleach include sodium sulphite and/or thiourea dioxide (TDO).

Co-Bleach Particle:

The composition may comprise a co-bleach particle. Typically, the co-bleach particle comprises a bleach activator and a source of peroxide. It may be highly suitable for a large amount of bleach activator relative to the source of hydrogen peroxide to be present in the co-bleach particle. The weight ratio of bleach activator to source of hydrogen peroxide present in the co-bleach particle can be at least 0.3:1, or at least 0.6:1, or at least 0.7:1, or at least 0.8:1, or at least 0.9:1, or at least 1.0:1.0, or even at least 1.2:1 or higher.

The co-bleach particle can comprise: (i) bleach activator, such as TAED; and (ii) a source of hydrogen peroxide, such as sodium percarbonate. The bleach activator may at least partially, or even completely, enclose the source of hydrogen peroxide.

amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfostyryl)biphenyl.

A particularly preferred fluorescent brightener is C.I. Fluorescent Brightener 260 having the following structure. For solid detergent compositions, this brightener may be used in its beta or alpha crystalline forms, or a mixture of these forms.

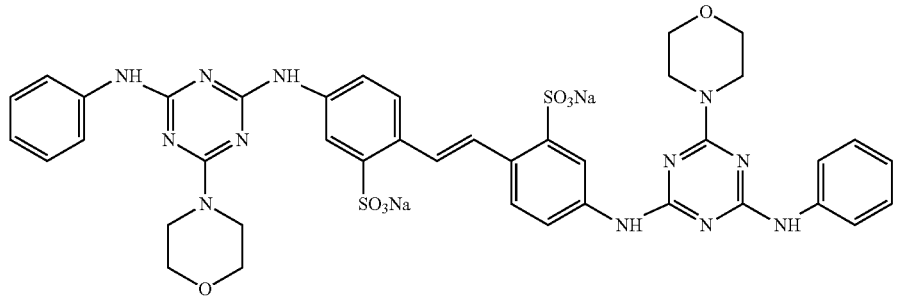

The co-bleach particle may comprise a binder. Suitable binders are carboxylate polymers such as polyacrylate polymers, and/or surfactants including non-ionic detersive surfactants and/or anionic detersive surfactants such as linear $C_{11}$-$C_{13}$ alkyl benzene sulphonate.

The co-bleach particle may comprise bleach catalyst, such as an oxaziridium-based bleach catalyst.

Chelant:

Suitable chelants are selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid), hydroxyethane di(methylene phosphonic acid), and any combination thereof. A suitable chelant is ethylene diamine-N'N'-disuccinic acid (EDDS) and/or hydroxyethane diphosphonic acid (HEDP). The laundry detergent composition may comprise ethylene diamine-N'N'-disuccinic acid or salt thereof. The ethylene diamine-N'N'-disuccinic acid may be in S,S enantiomeric form. The composition may comprise 4,5-dihydroxy-m-benzenedisulfonic acid disodium salt. Suitable chelants may also be calcium crystal growth inhibitors.

Calcium Carbonate Crystal Growth Inhibitor:

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

Photobleach:

Suitable photobleaches are zinc and/or aluminium sulphonated phthalocyanines.

Brightener:

The laundry detergent compositions may comprise fluorescent brightener. Preferred classes of fluorescent brightener are: Di-styryl biphenyl compounds, e.g. Tinopal™ CBS-X, Di-amino stilbene di-sulfonic acid compounds, e.g. Tinopal™ DMS pure Xtra and Blankophor™ HRH, and Pyrazoline compounds, e.g. Blankophor™ SN. Preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl)amino 1,3,5-triazin-2-yl)];

Enzyme:

Suitable enzymes include proteases, amylases, cellulases, lipases, xylogucanases, pectate lyases, mannanases, bleaching enzymes, cutinases, and mixtures thereof.

For the enzymes, accession numbers and IDs shown in parentheses refer to the entry numbers in the databases Genbank, EMBL and/or Swiss-Prot. For any mutations, standard 1-letter amino acid codes are used with a * representing a deletion. Accession numbers prefixed with DSM refer to micro-organisms deposited at Deutsche Sammlung von Mikroorganismen and Zellkulturen GmbH, Mascheroder Weg 1b, 38124 Brunswick (DSMZ).

Protease.

The composition may comprise a protease. Suitable proteases include metalloproteases and/or serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, Bacillus alkalophilus* (P27963, ELYA_BACAO), *Bacillus subtilis, Bacillus amyloliquefaciens* (P00782, SUBT_BACAM), *Bacillus pumilus* (P07518) and *Bacillus gibsonii* (DSM14391).

(b) trypsin-type or chymotrypsin-type proteases, such as trypsin (e.g. of porcine or bovine origin), including the *Fusarium* protease and the chymotrypsin proteases derived from *Cellumonas* (A2RQE2).

(c) metalloproteases, including those derived from *Bacillus amyloliquefaciens* (P06832, NPRE_BACAM).

Suitable proteases include those derived from *Bacillus gibsonii* or *Bacillus Lentus* such as subtilisin 309 (P29600) and/or DSM 5483 (P29599).

Suitable commercially available protease enzymes include: those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark); those sold under the tradename Maxatase®, Maxacal®, Maxapem®, Properase®, Purafect®, Purafect Prime®, Purafect Ox®, FN3®, FN4®, Excellase® and Purafect OXP® by Genencor International; those sold under the tradename Opticlean® and Optimase® by Solvay Enzymes; those available from Henkel/Kemira, namely BLAP (P29599 having the following mutations S99D+S101R+S103A+V104I+G159S), and variants thereof including BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D) all from Henkel/Kemira; and KAP (*Bacillus alkalophilus subtilisin* with mutations A230V+S256G+S259N) from Kao.

Other suitable protease enzymes are fungal serine proteases. Suitable enzymes are variants or wild-types of the fungal serine proteases endogenous to *Trichoderma reesei* strain QM9414, *Malbranchea cinnamomea* strain ALK04122, *Fusarium graminearum* strain ALK01726, *Fusarium equiseti* strain CBS 119568 and *Fusarium acuminatum* strain CBS 124084. Examples of commercially available fungal serine proteases are Biotouch ROC and Biotouch Novia, both supplied by AB Enzymes, Darmstadt, Germany.

Amylase:

Suitable amylases are alpha-amylases, including those of bacterial or fungal origin. Chemically or genetically modified mutants (variants) are included. A suitable alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, sp 707, DSM 9375, DSM 12368, DSMZ no. 12649, KSM AP1378, KSM K36 or KSM K38. Suitable amylases include:

(a) alpha-amylase derived from *Bacillus licheniformis* (PO6278, AMY_BACLI), and variants thereof, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444.

(b) AA560 amylase (CBU30457, HD066534) and variants thereof, especially the variants with one or more substitutions in the following positions: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, optionally that also contain the deletions of D183* and G184*.

(c) variants exhibiting at least 90% identity with the wild-type enzyme from *Bacillus* SP722 (CBU30453, HD066526), especially variants with deletions in the 183 and 184 positions.

Suitable commercially available alpha-amylases are Duramyl®, Liquezyme® Termamyl®, Termamyl Ultra®, Natalase®, Supramyl®, Stainzyme®, Stainzyme Plus®, Fungamyl® and BAN® (Novozymes A/S), Bioamylase® and variants thereof (Biocon India Ltd.), Kemzym® AT 9000 (Biozym Ges. m.b.H, Austria), Rapidase®, Purastar®, Optisize HT Plus®, Enzysize®, Powerase® and Purastar Oxam®, Maxamyl® (Genencor International Inc.) and KAM® (KAO, Japan). Suitable amylases are Natalase®, Stainzyme® and Stainzyme Plus®.

Cellulase:

The composition may comprise a cellulase. Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum*.

Commercially available cellulases include Celluzyme®, and Carezyme® (Novozymes A/S), Clazinase®, and Puradax HA® (Genencor International Inc.), and KAC-500 (B)® (Kao Corporation).

The cellulase can include microbial-derived endoglucanases exhibiting endo-beta-1,4-glucanase activity (E.C. 3.2.1.4), including a bacterial polypeptide endogenous to a member of the genus *Bacillus* sp. AA349 and mixtures thereof. Suitable endoglucanases are sold under the tradenames Celluclean® and Whitezyme® (Novozymes A/S, Bagsvaerd, Denmark).

The composition may comprise a cleaning cellulase belonging to Glycosyl Hydrolase family 45 having a molecular weight of from 17 kDa to 30 kDa, for example the endoglucanases sold under the tradename Biotouch® NCD, DCC and DCL (AB Enzymes, Darmstadt, Germany).

Suitable cellulases may also exhibit xyloglucanase activity, such as Whitezyme®.

Lipase.

The composition may comprise a lipase. Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*), or from *H. insolens*, a *Pseudomonas lipase*, e.g., from *P. alcaligenes* or *P. pseudoalcaligenes, P. cepacia, P. stutzeri, P. fluorescens, Pseudomonas* sp. strain SD 705, *P. wisconsinensis*, a *Bacillus lipase*, e.g., from *B. subtilis, B. stearothermophilus* or *B. pumilus*.

The lipase may be a "first cycle lipase", optionally a variant of the wild-type lipase from *Thermomyces lanuginosus* comprising T231R and N233R mutations. The wild-type sequence is the 269 amino acids (amino acids 23-291) of the Swissprot accession number Swiss-Prot O59952 (derived from *Thermomyces lanuginosus* (*Humicola lanuginosa*)). Suitable lipases would include those sold under the tradenames Lipex®, Lipolex® and Lipoclean® by Novozymes, Bagsvaerd, Denmark.

The composition may comprise a variant of *Thermomyces lanuginosa* (O59952) lipase having >90% identity with the wild type amino acid and comprising substitution(s) at T231 and/or N233, optionally T231R and/or N233R.

Xyloglucanase:

Suitable xyloglucanase enzymes may have enzymatic activity towards both xyloglucan and amorphous cellulose substrates. The enzyme may be a glycosyl hydrolase (GH) selected from GH families 5, 12, 44 or 74. The glycosyl hydrolase selected from GH family 44 is particularly suitable. Suitable glycosyl hydrolases from GH family 44 are the XYG1006 glycosyl hydrolase from *Paenibacillus polyxyma* (ATCC 832) and variants thereof.

Pectate Lyase:

Suitable pectate lyases are either wild-types or variants of *Bacillus*-derived pectate lyases (CAF05441, AAU25568) sold under the tradenames Pectawash®, Pectaway® and X-Pect® (from Novozymes A/S, Bagsvaerd, Denmark).

Mannanase:

Suitable mannanases are sold under the tradenames Mannaway® (from Novozymes A/S, Bagsvaerd, Denmark), and Purabrite® (Genencor International Inc., Palo Alto, Calif.).

Bleaching Enzyme:

Suitable bleach enzymes include oxidoreductases, for example oxidases such as glucose, choline or carbohydrate oxidases, oxygenases, catalases, peroxidases, like halo-, chloro-, bromo-, lignin-, glucose- or manganese-peroxidases, dioxygenases or laccases (phenoloxidases, polyphenoloxidases). Suitable commercial products are sold under the Guardzyme® and Denilite® ranges from Novozymes. It may be advantageous for additional organic compounds, especially aromatic compounds, to be incorporated with the bleaching enzyme; these compounds interact with the bleaching enzyme to enhance the activity of the oxidoreductase (enhancer) or to facilitate the electron flow (mediator) between the oxidizing enzyme and the stain typically over strongly different redox potentials.

Other suitable bleaching enzymes include perhydrolases, which catalyse the formation of peracids from an ester substrate and peroxygen source. Suitable perhydrolases include variants of the *Mycobacterium smegmatis* perhydrolase, variants of so-called CE-7 perhydrolases, and variants of wild-type subtilisin Carlsberg possessing perhydrolase activity.

Cutinase:

Suitable cutinases are defined by E.C. Class 3.1.1.74 optionally displaying at least 90%, or 95%, or most optionally at least 98% identity with a wild-type derived from one of *Fusarium solani, Pseudomonas Mendocina* or *Humicola Insolens*. Cutinases detailed above in relation to step (i) are also suitable.

Identity.

The relativity between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

Fabric-Softener:

Suitable fabric-softening agents include clay, silicone and/or quaternary ammonium compounds. Suitable clays include montmorillonite clay, hectorite clay and/or laponite clay. A suitable clay is montmorillonite clay. Suitable silicones include amino-silicones and/or polydimethylsiloxane (PDMS). A suitable fabric softener is a particle comprising clay and silicone, such as a particle comprising montmorillonite clay and PDMS.

Flocculant:

Suitable flocculants include polyethylene oxide; for example having an average molecular weight of from 300,000 Da to 900,000 Da.

Suds Suppressor:

Suitable suds suppressors include silicone and/or fatty acid such as stearic acid.

Perfume:

Suitable perfumes include perfume microcapsules, polymer assisted perfume delivery systems including Schiff base perfume/polymer complexes, starch-encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Aesthetic:

Suitable aesthetic particles include soap rings, lamellar aesthetic particles, geltin beads, carbonate and/or sulphate salt speckles, coloured clay particles, and any combination thereof.

EXAMPLES

Example 1

A composition was prepared comprising alkyl ethoxylated sulphate anionic surfactant, a polydimethyl siloxane containing suds suppressor and sodium bicarbonate. This composition was labeled pre-treatment composition 1.

A second pre-treatment composition was prepared which was identical to pre-treatment composition 1, but which also comprised a cutinase corresponding to Claim 5, part (u) of EP1290150B1 which corresponds to a lipid esterase from E.C. class 3.1.1.74.

Standard fabric swatches TF7436-M polycotton (25×20 cm swatches) and Dacron 64 polyester (25×20 cm swatches) were obtained from Westlairds. Also obtained were standard Equest KC knitted cotton (25×20 cm) swatches. Four of each of these were added to a washing machine together with 455 g of cotton tea towels as ballast.

The swatches were then washed in the 'short cotton cycle' (40° C.) at 1600 rpm together with the relevant pre-treatment composition added to the drawer of the washing machine so that it would be added during the wash cycle. The fabrics were then dried on a line. This was repeated so that all swatches had been washed four times together with the same pre-treatment composition with drying between washes and a final tumble dry after the last wash. The pre-treatment compositions were prepared such that the 13 L wash liquor comprised 100 ppm linear alkylbenzene sulphonate anionic surfactant present in the wash liquor. Sodium bicarbonate was added to the wash liquor at a concentration of 400 ppm, and the suds suppressor (12.4% active) at a concentration of 46 ppm. The lipid esterase was added to the wash liquor at a concentration of 1 ppm.

The lipid esterase concentration on the fabrics for fabrics treated with pre-treatment 2 was tested using an enzyme linked immunosorbant assay (ELISA). A sample preparation buffer was first prepared by weighing 0.93 g Trizma base, 4.96 g sodium thiosulfate pentahydrate, 0.147 g calcium chloride and 29.22 g sodium chloride into a 1000 ml beaker. To this, 800 ml deionised water was added and stirred to dissolve the ingredients. To this, 1 g of bovine serum albumin (BSA) was added and the solution stirred. Hydrochloric acid was added to adjust the pH to 8 and then 0.1 g sodium azide was added. 1 ml of Tween 20 was then added. To this, the fabric swatch was added and agitated for 30 minutes. A volume of 25 ml of this was solution was then taken and added to a centrifuge tube and placed in sample rotator for at least 30 mins.

A volume of 100 μl of this was placed in the well of microtitre plate, covered and allowed to incubate for 90 mins. A volume of 10 μl of the appropriate detecting antibody (made using standard biochemical means) was added to 11 ml of blocking buffer (2 g of bovine serum albumin dissolved in 100 ml of wash buffer [wash buffer;

29.22 g sodium chloride, 1.86 g Trisma-base and 1 g bovine serum albumin, dissolved in desionised water, pH adjusted to 8, 0.5 ml Tween 20 added and the volume made up to 1000 ml]) and mixed gently to produce a detecting antibody solution. The microtitre plate was washed with wash buffer, and 100 μl of the detected antibody solution was added. To 11 ml of blocking buffer, 10 μl of a peroxide solution was added. The microtitre plate was washed with wash buffer and the peroxide in blocking buffer solution added. The plate was covered and allowed to stand for 60 mins at room temperature.

An OPD substrate solution was prepared by adding a 15 mg tablet of OPD (commercially available from Sigma) to 30 ml of a citrate/phosphate buffer (7.3 g of citric acid monohydrate and 23.87 g $Na_2HPO_4.12H_2O$ dissolved in deionised water, pH adjusted to pH 5 and the volume made up to 1000 ml) in a centrifuge tube wrapped in foil. The tube was capped and mixed gently. To the tube, 10 μl of 30% hydrogen peroxide was added and the plate then washed with wash buffer. The plate was then washed with citrate/phosphate buffer and 100 μl of OPD substrate solution added to the well. Following this, 150 μl of 1M $H_2SO_4$ was added to the well to stop the reaction. The microtitre plate was read in a microtitre plate reader at 492 and 620 nm (dual wavelength mode). The 620 nm value was subtracted from the 492 nm value. The final values obtained were then compared to a calibration curve prepared earlier. Those skilled in the art would know how to prepare a standard calibration curve. From the calibration curve the amount of enzyme present on the fabric was calculated. Results can be seen in Table 1.

TABLE 1

| Treatment | Fabric | Replicate 1 (ng/g) | Replicate 2 (ng/g) |
|---|---|---|---|
| 2 | Polyester | 15200 | 15200 |
| 2 | Polycotton | 6300 | 6500 |

Fabrics were then added to a pot containing a soil solution of 5 wt % carbon black in olive oil. Fabrics were treated in a tergotometer with a granular laundry detergent composition detailed in Table 2. The detergent was dosed at a concentration of 1 g/L. Wash conditions in the tergotometer were 200 rpm, wash time 30 mins at 30° C. and rinse time of 5 mins. This was repeated so that each fabric wash treated to 2 wash cycles and then air dried after the final cycle.

TABLE 2

| (percentage by weight of the detergent composition) | |
|---|---|
| Linear sodium alkyl benzene sulfonate | 8 wt % |
| Ethoxylated fatty alcohol (14 EO) | 2.875 wt % |
| Sodium soap (C12-16: 13-26%, C18-22: 74-87%) | 3.5 wt % |
| Sodium tripolyphosphate | 43.75 wt % |
| Sodium silicate (SiO2:Na2O = 3.3:1) | 7.5 wt % |
| Magnesium silicate | 1.875 wt % |
| Carboxymethylcellulose | 1.25 wt % |
| Ethylenediamine-tetra-acetic-sodium-salt | 0.25 wt % |
| Optical whitener for cotton (dimorpholinostilbene type) | 0.25 wt % |

TABLE 2-continued

| (percentage by weight of the detergent composition) | |
|---|---|
| Sodium sulphate | 21 wt % |
| Water | 9.75 wt % |
| Hueing agent 1 or 2* | Hueing agent 1 - 11.4 ppm, Hueing agent 2 - 57.82 ppm |

A cutinase variant corresponding to Claim 5, part (u) of EP1290150B1 was added to the wash liquor at a concentration of 1 ppm (active enzyme protien).
*hueing agent 1 was selected from hueing agents having the following structure:

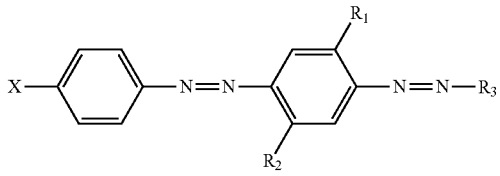

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and optionally an alkyl and/or aryl moiety, and wherein the substituent group comprises at least one alkyleneoxy chain that comprises at least four alkyleneoxy moieties;

hueing agent 2 was selected from hueing agents comprising;

a) a Zn-, Ca-, Mg-, Na-, K-, Al, Si-, Ti-, Ge-, Ga-, Zr-, In- or Sn-phthalocyanine compound of formula (1)

(PC)-L-(D) (1)

to which at least one mono-azo dyestuff is attached through a covalent bonding via a linking group L wherein PC is a metal-containing phthalocyanine ring system;

D is the radical of a mono-azo dyestuff; and

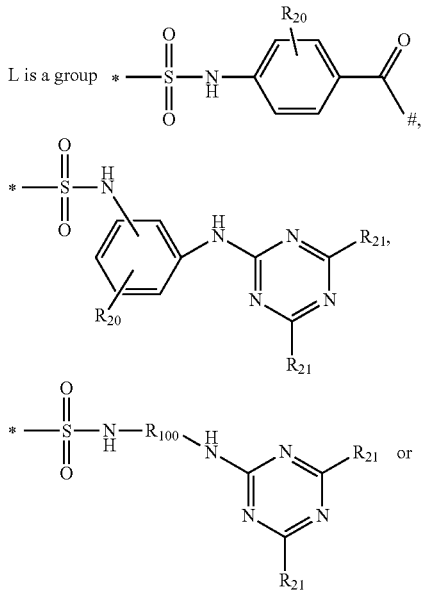

-continued

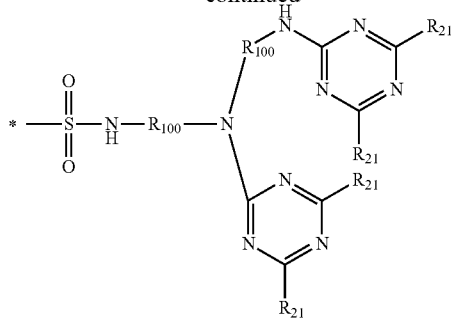

wherein $R_{20}$ is hydrogen, $C_1$-$C_8$alkyl, $C_1$-$C_8$alkoxy or halogen;

$R_{21}$ is independently D, hydrogen, OH, Cl or F, with the proviso that at least one is D;

$R_{100}$ is $C_1$-$C_8$alkylene

* is the point of attachment of PC;

# is the point of attachment of the dye.

The fabrics were analysed using commercially available ColourEye software for L, a, b values. Ganz and CIE values were then calculated from the L, a, b values obtained using the commercially available Color Slide Rule by Axiphos. Ganz and CIE values are a measure of the whiteness of the fabric and are calculated using the L*a*b* values. The higher the CIE or Ganz value, the better the hue The following fabrics were compared;

TABLE 2

| | Wash solution | Precondition |
|---|---|---|
| A | Detergent composition | treatment 1 |
| B | Detergent composition | treatment 2 |
| C | Detergent composition + hueing agent 1 | treatment 1 |
| D | Detergent composition + hueing agent 1 | treatment 2 |
| E | Detergent composition + hueing agent 2 | treatment 1 |
| F | Detergent composition + hueing agent 2 | treatment 2 |

Results can be seen in Table 3;

TABLE 3

| | A | B | C | D | E | F |
|---|---|---|---|---|---|---|
| L* | 43.29 | 77.34 | 66.97 | 78.34 | 52.33 | 81.35 |
| Standard deviation of L* | 1.70 | 0.43 | 1.30 | 0.46 | 1.67 | 0.33 |
| a* | 0.32 | −0.04 | 1.87 | 2.64 | 0.08 | −0.83 |
| Standard deviation of a* | 0.03 | 0.03 | 0.06 | 0.15 | 0.04 | 0.04 |
| b* | 0.63 | 0.08 | −3.62 | −6.61 | 0.32 | −1.33 |
| Standard deviation of b* | 0.08 | 0.14 | 0.26 | 0.15 | 0.18 | 0.12 |
| CIE | 8.08 | 51.63 | 58.48 | 88.75 | 18.06 | 65.98 |
| Standard deviation of CIE | 1.72 | 1.21 | 2.92 | 1.30 | 2.81 | 1.08 |
| Ganz | 1.49 | 51.09 | 84.83 | 131.01 | 15.11 | 74.56 |
| Standard deviation of Ganz | 2.61 | 2.03 | 4.44 | 2.09 | 4.50 | 1.77 |

As can be seen from table 3 when fabrics were pre-treated with a lipid esterase, the final CIE and Ganz values are higher than fabrics not pre-treated with a lipid esterase. In each case the CIE and Ganz values are higher for fabrics washed with a hueing agent than those washed in the absence of a hueing agent. Thus, it is the combination of washing with hueing agent and pre-treatment with a lipid esterase that provides the best CIE and Ganz values.

Examples 2-20

The following examples are of laundry detergent compositions suitable for use in step (iii);

Examples 2-7

Granular laundry detergent compositions designed for hand washing or top-loading washing machines may be added to sufficient water to form a paste for direct contact with the surface to be treated, forming a concentrated cleaning composition.

| | 2 (wt %) | 3 (wt %) | 4 (wt %) | 5 (wt %) | 6 (wt %) | 7 (wt %) |
|---|---|---|---|---|---|---|
| Linear alkylbenzenesulfonate | 20 | 22 | 20 | 15 | 20 | 20 |
| $C_{12-14}$ Dimethylhydroxyethyl ammonium chloride | 0.7 | 0.2 | 1 | 0.6 | 0.0 | 0 |
| AE3S | 0.9 | 1 | 0.9 | 0.0 | 0.5 | 0.9 |
| AE7 | 0.0 | 0.0 | 0.0 | 1 | 0.0 | 3 |
| Sodium tripolyphosphate | 5 | 0.0 | 4 | 9 | 2 | 0.0 |
| Zeolite A | 0.0 | 1 | 0.0 | 1 | 4 | 1 |
| 1.6R Silicate ($SiO_2$:$Na_2O$ at ratio 1.6:1) | 7 | 5 | 2 | 3 | 3 | 5 |
| Sodium carbonate | 25 | 20 | 25 | 17 | 18 | 19 |
| Polyacrylate MW 4500 | 1 | 0.6 | 1 | 1 | 1.5 | 1 |
| Random graft copolymer[1] | 0.1 | 0.2 | 0.0 | 0.0 | 0.0 | 0.0 |
| Carboxymethyl cellulose | 1 | 0.3 | 1 | 1 | 1 | 1 |
| Stainzyme ® (20 mg active/g) | 0.1 | 0.2 | 0.1 | 0.2 | 0.1 | 0.1 |
| Bacterial protease (Savinase ®, 32.89 mg active/g) | 0.1 | 0.1 | 0.1 | 0.1 | | 0.1 |
| Natalase ® (8.65 mg active/g) | 0.1 | 0.0 | 0.1 | 0.0 | 0.1 | 0.1 |
| Lipex ® (18 mg active/g) | 0.03 | 0.07 | 0.3 | 0.1 | 0.07 | 0.4 |
| Biotouch ® ROC (20 mg active/g) | 0.1 | 0.2 | 0.2 | 0.2 | 0.1 | 0.4 |
| Fluorescent Brightener 1 | 0.06 | 0.0 | 0.06 | 0.18 | 0.06 | 0.06 |
| Fluorescent Brightener 2 | 0.1 | 0.06 | 0.1 | 0.0 | 0.1 | 0.1 |
| DTPA | 0.6 | 0.8 | 0.6 | 0.25 | 0.6 | 0.6 |
| $MgSO_4$ | 1 | 1 | 1 | 0.5 | 1 | 1 |

-continued

| | 2 (wt %) | 3 (wt %) | 4 (wt %) | 5 (wt %) | 6 (wt %) | 7 (wt %) |
|---|---|---|---|---|---|---|
| Sodium Percarbonate | 0.0 | 5.2 | 0.1 | 0.0 | 0.0 | 0.0 |
| Sodium Perborate Monohydrate | 4.4 | 0.0 | 3.85 | 2.09 | 0.78 | 3.63 |
| NOBS | 1.9 | 0.0 | 1.66 | 0.0 | 0.33 | 0.75 |
| TAED | 0.58 | 1.2 | 0.51 | 0.0 | 0.015 | 0.28 |
| Sulphonated zinc phthalocyanine | 0.0030 | 0.0 | 0.0012 | 0.0030 | 0.0021 | 0.0 |
| S-ACMC | 0.1 | 0.0 | 0.0 | 0.0 | 0.06 | 0.0 |
| Direct Violet 9 | 0.0 | 0.0 | 0.0003 | 0.0005 | 0.0003 | 0.0 |
| Acid Blue 29 | 0.0 | 0.0 | 0.0 | 0.0 | 0.0 | 0.0003 |
| Sulfate/Moisture | | | Balance | | | |

Examples 8-13

Granular laundry detergent compositions designed for front-loading automatic washing machines may be added to sufficient water to form a paste for direct contact with the surface to be treated, forming a concentrated cleaning composition.

| | 8 (wt %) | 9 (wt %) | 10 (wt %) | 11 (wt %) | 12 (wt %) | 13 (wt %) |
|---|---|---|---|---|---|---|
| Linear alkylbenzenesulfonate | 8 | 7.1 | 7 | 6.5 | 7.5 | 7.5 |
| AE3S | 0 | 4.8 | 0 | 5.2 | 4 | 4 |
| C12-14 Alkylsulfate | 1 | 0 | 1 | 0 | 0 | 0 |
| AE7 | 2.2 | 0 | 3.2 | 0 | 0 | 0 |
| $C_{10-12}$ Dimethyl hydroxyethylammonium chloride | 0.75 | 0.94 | 0.98 | 0.98 | 0 | 0 |
| Crystalline layered silicate (δ-$Na_2Si_2O_5$) | 4.1 | 0 | 4.8 | 0 | 0 | 0 |
| Zeolite A | 5 | 0 | 5 | 0 | 2 | 2 |
| Citric Acid | 3 | 5 | 3 | 4 | 2.5 | 3 |
| Sodium Carbonate | 15 | 20 | 14 | 20 | 23 | 23 |
| Silicate 2R ($SiO_2$:$Na_2O$ at ratio 2:1) | 0.08 | 0 | 0.11 | 0 | 0 | 0 |
| Soil release agent | 0.75 | 0.72 | 0.71 | 0.72 | 0 | 0 |
| Acrylic Acid/Maleic Acid Copolymer | 1.1 | 3.7 | 1.0 | 3.7 | 2.6 | 3.8 |
| Carboxymethylcellulose | 0.15 | 1.4 | 0.2 | 1.4 | 1 | 0.5 |
| Bacterial protease (84 mg active/g) | 0.2 | 0.2 | 0.3 | 0.15 | 0.12 | 0.13 |
| Stainzyme ® (20 mg active/g) | 0.2 | 0.15 | 0.2 | 0.3 | 0.15 | 0.15 |
| Lipex ® (18.00 mg active/g) | 0.05 | 0.15 | 0.1 | 0 | 0 | 0 |
| Natalase ® (8.65 mg active/g) | 0.1 | 0.2 | 0 | 0 | 0.15 | 0.15 |
| Celluclean ™ (15.6 mg active/g) | 0 | 0 | 0 | 0 | 0.1 | 0.1 |
| Biotouch ® ROC (20 mg active/g) | 0.2 | 0.1 | 0.2 | 0.2 | 0.2 | 0.2 |
| TAED | 3.6 | 4.0 | 3.6 | 4.0 | 2.2 | 1.4 |
| Percarbonate | 13 | 13.2 | 13 | 13.2 | 16 | 14 |
| Na salt of Ethylenediamine-N,N'-disuccinic acid, (S,S) isomer (EDDS) | 0.2 | 0.2 | 0.2 | 0.2 | 0.2 | 0.2 |
| Hydroxyethane di phosphonate (HEDP) | 0.2 | 0.2 | 0.2 | 0.2 | 0.2 | 0.2 |
| $MgSO_4$ | 0.42 | 0.42 | 0.42 | 0.42 | 0.4 | 0.4 |
| Perfume | 0.5 | 0.6 | 0.5 | 0.6 | 0.6 | 0.6 |
| Suds suppressor agglomerate | 0.05 | 0.1 | 0.05 | 0.1 | 0.06 | 0.05 |
| Soap | 0.45 | 0.45 | 0.45 | 0.45 | 0 | 0 |
| Sulphonated zinc phthalocyanine (active) | 0.0007 | 0.0012 | 0.0007 | 0 | 0 | 0 |
| S-ACMC | 0.01 | 0.01 | 0 | 0.01 | 0 | 0 |
| Direct Violet 9 (active) | 0 | 0 | 0.0001 | 0.0001 | 0 | 0 |
| Sulfate/Water & Miscellaneous | | | Balance | | | |

Any of the above compositions is used to launder fabrics in the second step at a concentration of 7000 to 10000 ppm in water, 20-90° C., and a 5:1 water:cloth ratio. The typical pH is about 10. The fabrics are then dried. In one aspect, the fabrics are actively dried using a dryer. In one aspect, the fabrics are actively dried using an iron. In another aspect, the fabrics are merely allowed to dry on a line wherein they are exposed to air and optionally sunlight.

Examples 14-19

Heavy Duty Liquid Laundry Detergent Compositions

| | 14 (wt %) | 15 (wt %) | 16 (wt %) | 17 (wt %) | 18 (wt %) | 19 (wt %) |
|---|---|---|---|---|---|---|
| AES $C_{12-15}$ alkyl ethoxy (1.8) sulfate | 11 | 10 | 4 | 6.32 | 0 | 0 |
| AE3S | 0 | 0 | 0 | 0 | 2.4 | 0 |
| Linear alkyl benzene sulfonate | 1.4 | 4 | 8 | 3.3 | 5 | 8 |
| HSAS | 3 | 5.1 | 3 | 0 | 0 | 0 |
| Sodium formate | 1.6 | 0.09 | 1.2 | 0.04 | 1.6 | 1.2 |
| Sodium hydroxide | 2.3 | 3.8 | 1.7 | 1.9 | 1.7 | 2.5 |
| Monoethanolamine | 1.4 | 1.49 | 1.0 | 0.7 | 0 | 0 |
| Diethylene glycol | 5.5 | 0.0 | 4.1 | 0.0 | 0 | 0 |
| AE9 | 0.4 | 0.6 | 0.3 | 0.3 | 0 | 0 |
| AE7 | 0 | 0 | 0 | 0 | 2.4 | 6 |
| Chelant | 0.15 | 0.15 | 0.11 | 0.07 | 0.5 | 0.11 |
| Citric Acid | 2.5 | 3.96 | 1.88 | 1.98 | 0.9 | 2.5 |
| $C_{12-14}$ dimethyl Amine Oxide | 0.3 | 0.73 | 0.23 | 0.37 | 0 | 0 |
| $C_{12-18}$ Fatty Acid | 0.8 | 1.9 | 0.6 | 0.99 | 1.2 | 0 |
| 4-formyl-phenylboronic acid | 0 | 0 | 0 | 0 | 0.05 | 0.02 |
| Borax | 1.43 | 1.5 | 1.1 | 0.75 | 0 | 1.07 |
| Ethanol | 1.54 | 1.77 | 1.15 | 0.89 | 0 | 3 |
| Ethoxylated ($EO_{15}$) tetraethylene pentamine | 0.3 | 0.33 | 0.23 | 0.17 | 0.0 | 0.0 |
| Ethoxylated hexamethylene diamine | 0.8 | 0.81 | 0.6 | 0.4 | 1 | 1 |
| 1,2-Propanediol | 0.0 | 6.6 | 0.0 | 3.3 | 0.5 | 2 |
| Bacterial protease (40.6 mg active/g) | 0.8 | 0.6 | 0.7 | 0.9 | 0.7 | 0.6 |
| Mannaway ® (25 mg active/g) | 0.07 | 0.05 | 0.045 | 0.06 | 0.04 | 0.045 |
| Stainzyme ® (15 mg active/g) | 0.3 | 0.2 | 0.3 | 0.1 | 0.2 | 0.4 |
| Natalase ® (29 mg active/g) | 0 | 0.2 | 0.1 | 0.15 | 0.07 | 0 |
| Lipex ® (18 mg active/g) | 0.4 | 0.2 | 0.3 | 0.1 | 0.2 | 0 |
| Biotouch ® ROC (20 mg active/g) | 0.2 | 0.1 | 0.2 | 0.2 | 0.1 | 0.1 |
| Liquitint ® Violet CT (active) | 0.006 | 0.002 | 0 | 0 | 0 | 0.002 |
| S-ACMC | — | — | 0.01 | 0.05 | 0.01 | 0.02 |
| Water, perfume, dyes & other components | | | Balance | | | |

Example 20

This composition may be enclosed in a polyvinyl alcohol pouch.

| | 19 (wt %) |
|---|---|
| Alkylbenzene sulfonic acid | 21.0 |
| $C_{14-15}$ alkyl 8-ethoxylate | 18.0 |
| $C_{12-18}$ Fatty acid | 15.0 |
| Bacterial protease (40.6 mg active/g) | 1.5 |
| Natalase ® (29 mg active/g) | 0.2 |
| Mannanase (Mannaway ®, 11 mg active/g) | 0.1 |
| Xyloglucanase (Whitezyme ®, 20 mg active/g) | 0.2 |
| Biotouch ® ROC (20 mg active/g) | 0.2 |

-continued

| | 19 (wt %) |
|---|---|
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 2.0 |
| Ethoxylated Polyethylenimine[2] | 0.8 |
| Hydroxyethane diphosphonate (HEDP) | 0.8 |
| Fluorescent Brightener 1 | 0.2 |
| Solvents (1,2 propanediol, ethanol), stabilizers | 15.0 |
| Hydrogenated castor oil derivative structurant | 0.1 |
| Perfume | 1.6 |
| Core Shell Melamine-formaldehyde encapsulate of perfume | 0.10 |
| Ethoxylated thiophene Hueing Dye | 0.004 |
| Buffers (sodium hydroxide, Monoethanolamine) | To pH 8.2 |
| Water* and minors (antifoam, aesthetics) | To 100% |

*Based on total cleaning and/or treatment composition weight, a total of no more than 7% water

[1]Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

[2]Polyethyleneimine (MW = 600) with 20 ethoxylate groups per —NH.

*Remark: all enzyme levels expressed as % enzyme raw material

Raw Materials and Notes for Composition Examples 2-20

Linear alkylbenzenesulfonate having an average aliphatic carbon chain length $C_{11}$-$C_{12}$ supplied by Stepan, Northfield, Ill., USA $C_{12-14}$ Dimethylhydroxyethyl ammonium chloride, supplied by Clariant GmbH, Sulzbach, Germany AE3S is $C_{12-15}$ alkyl ethoxy (3) sulfate supplied by Stepan, Northfield, Ill., USA AE7 is $C_{12-15}$ alcohol ethoxylate, with an average degree of ethoxylation of 7, supplied by Huntsman, Salt Lake City, Utah, USA AE9 is $C_{12-13}$ alcohol ethoxylate, with an average degree of ethoxylation of 9, supplied by Huntsman, Salt Lake City, Utah, USA HSAS is a mid-branched primary alkyl sulfate with carbon chain length of about 16-17

Sodium tripolyphosphate is supplied by Rhodia, Paris, France

Zeolite A is supplied by Industrial Zeolite (UK) Ltd, Grays, Essex, UK 1.6R Silicate is supplied by Koma, Nestemica, Czech Republic Sodium Carbonate is supplied by Solvay, Houston, Tex., USA Polyacrylate MW 4500 is supplied by BASF, Ludwigshafen, Germany Carboxymethyl cellulose is Finnfix® V supplied by CP Kelco, Arnhem, Netherlands Suitable chelants are, for example, diethylenetetraamine pentaacetic acid (DTPA) supplied by Dow Chemical, Midland, Mich., USA or Hydroxyethane di phosphonate (HEDP) supplied by Solutia, St Louis, Mo., USA Bagsvaerd, Denmark Savinase®, Natalase®, Stainzyme®, Lipex®, Celluclean™, Mannaway® and Whitezyme® are all products of Novozymes, Bagsvaerd, Denmark.

Biotouch® ROC is a product of AB Enzymes, Darmstadt, Germany.

Bacterial protease (examples 8-13) described in U.S. Pat. No. 6,312,936 B1 supplied by Genencor International, Palo Alto, Calif., USA Bacterial protease (examples 14-20) described in U.S. Pat. No. 4,760,025 is supplied by Genencor International, Palo Alto, Calif., USA Fluorescent Brightener 1 is Tinopal® AMS, Fluorescent Brightener 2 is Tinopal® CBS-X, Sulphonated zinc phthalocyanine and Direct Violet 9 is Pergasol® Violet BN-Z all supplied by Ciba Specialty Chemicals, Basel, Switzerland Sodium percarbonate supplied by Solvay, Houston, Tex., USA Sodium perborate is supplied by Degussa, Hanau, Germany NOBS is sodium nonanoyloxybenzenesulfonate, supplied by Future Fuels, Batesville, Ark., USA TAED is tetraacetylethylenediamine, supplied under the Peractive® brand name by Clariant GmbH, Sulzbach, Germany S-ACMC is carboxymethylcellulose conjugated with C.I. Reactive Blue 19, sold by Megazyme, Wicklow, Ireland under the product name AZO-CM-CELLULOSE, product code S-ACMC.

Soil release agent is Repel-o-tex® PF, supplied by Rhodia, Paris, France

Acrylic Acid/Maleic Acid Copolymer is molecular weight 70,000 and acrylate:maleate ratio 70:30, supplied by BASF, Ludwigshafen, Germany Na salt of Ethylenediamine-N,N'-disuccinic acid, (S,S) isomer (EDDS) is supplied by Octel, Ellesmere Port, UK Hydroxyethane di phosphonate (HEDP) is supplied by Dow Chemical, Midland, Mich., USA Suds suppressor agglomerate is supplied by Dow Corning, Midland, Mich., USA HSAS is mid-branched alkyl sulfate as disclosed in U.S. Pat. Nos. 6,020,303 and 6,060,443

$C_{12-14}$ dimethyl Amine Oxide is supplied by Procter & Gamble Chemicals, Cincinnati, Ohio, USA Liquitint® Violet CT is supplied by Milliken, Spartanburg, S.C., USA.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of laundering a fabric consisting of the steps of;

(i) contacting the fabric with a cutinase, (ii) contacting the fabric from step (i) with a soil;

(iii) contacting the fabric from step (ii) with a first laundry detergent composition, wherein the first laundry detergent composition comprises a first hueing agent, wherein the cutinase is a lipid esterase selected from the class E.C. 3.1.1.74, wherein the fabric comprises cotton, wherein the first hueing agent has the following structure:

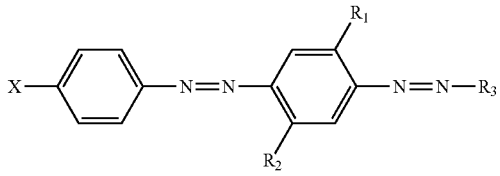

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and an alkyl and/or aryl moiety, and wherein the substituent group consists of one alkyleneoxy chain that consists of ten ethylene oxide moieties;

(iv) drying the fabric; and (v) contacting the fabric from step (iv) with a second laundry detergent composition comprising a detersive surfactant and the first hueing dye, wherein in step (i) the lipid esterase is present at a concentration of between about 500 and about 30,000 ng enzyme/g fabric, wherein the cutinase is derived from the strain *Humicola insolens* DSM 1800.

2. A method according to claim 1, wherein the second laundry detergent composition further comprises a second hueing agent comprising:

a) a Zn-, Ca-, Mg-, Na-, K-, Al, Si-, Ti-, Ge-, Ga-, Zr-, In- or Sn-phthalocyanine compound of formula (1)

(PC)-L-(D) (1)

to which at least one mono-azo dyestuff is attached through a covalent bonding via a linking group L wherein PC is a metal-containing phthalocyanine ring system;

D is the radical of a mono-azo dyestuff; and

L is a group 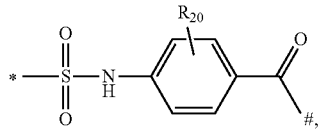

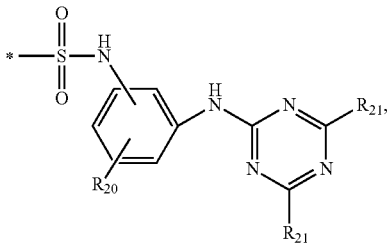

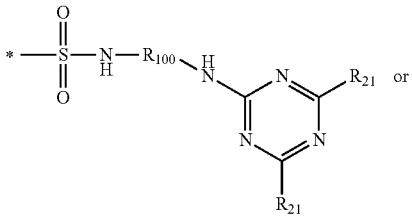

-continued

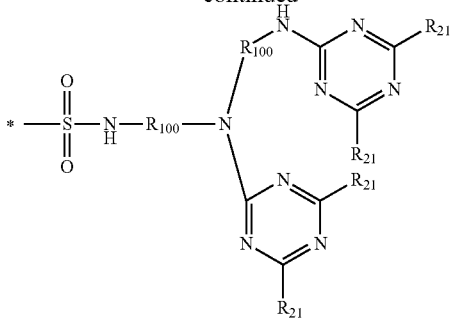

wherein $R_{20}$ is hydrogen, $C_1$-$C_8$alkyl, $C_1$-$C_8$alkoxy or halogen;

$R_{21}$ is independently D, hydrogen, OH, Cl or F, with the proviso that at least one is D;

$R_{100}$ is $C_1$-$C_8$alkylene

* is the point of attachment of PC; and # is the point of attachment of the dye.

3. A method according to claim 1 wherein the first hueing agent further falls into the C.I classification of Acid.

4. A method according to claim 1 wherein the detersive surfactant is an anionic detersive surfactant.

5. A method according to claim 1, wherein the second laundry detergent composition further comprises a polymer.

6. A method according to claim 5, wherein the polymer is a dye transfer inhibition polymer.

7. A method according to claim 1, wherein the second laundry detergent composition further comprises from about 0 wt % to about 10 wt % zeolite, from about 0 wt % to about 10 wt % phosphate, or a combination thereof.

* * * * *